US009855745B2

(12) United States Patent
Morikoshi et al.

(10) Patent No.: US 9,855,745 B2
(45) Date of Patent: Jan. 2, 2018

(54) LIQUID EJECTING APPARATUS

(71) Applicant: SEIKO EPSON CORPORATION, Tokyo (JP)

(72) Inventors: Koji Morikoshi, Shiojiri (JP); Haruki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/337,777

(22) Filed: Oct. 28, 2016

(65) Prior Publication Data

US 2017/0120593 A1 May 4, 2017

(30) Foreign Application Priority Data

Nov. 4, 2015 (JP) ..... 2015-216389

(51) Int. Cl.
*B41J 2/045* (2006.01)
*B41J 2/14* (2006.01)

(52) U.S. Cl.
CPC ..... *B41J 2/14201* (2013.01); *B41J 2/14233* (2013.01); *B41J 2002/14362* (2013.01); *B41J 2202/11* (2013.01)

(58) Field of Classification Search
CPC ..... B41J 2/14274; B41J 2002/14258; B41J 2/14233
USPC ..... 347/68, 70–72
See application file for complete search history.

(56) References Cited

U.S. PATENT DOCUMENTS 8,596,767 B2 * 12/2013 Miyata ..... B41J 2/14233 347/68
9,352,579 B2 * 5/2016 Kobayashi ..... B41J 2/17513
2016/0271948 A1 * 9/2016 Hamaguchi ..... B41J 2/14233

FOREIGN PATENT DOCUMENTS

JP 2006-150768 6/2006
JP 2013-202827 10/2013

* cited by examiner

*Primary Examiner* — An Do
(74) *Attorney, Agent, or Firm* — Workman Nydegger

(57) ABSTRACT

A liquid ejecting apparatus includes a liquid ejection unit including a liquid ejection head for ejecting liquid, a housing accommodating the liquid ejection unit, and a sealing section provided between the liquid ejection unit and the housing.

9 Claims, 5 Drawing Sheets

LIQUID EJECTING APPARATUS

BACKGROUND

1. Technical Field

The present invention relates to a technique for ejecting liquid such as ink.

2. Related Art

Liquid ejecting apparatuses have a liquid ejection head for ejecting liquid onto a medium such as printing paper. Such a liquid ejection head produces tiny liquid droplets (hereinafter, referred to as mist) that remain suspended inside the apparatus after ejection without reaching the medium. For example, JP-A-2006-150768 discloses a structure that blocks an opening of a head case section that supports a liquid ejection head using a cover member to prevent the adhesion of mist to electronic components and a circuit board disposed in a space communicating with the opening.

The structure disclosed in JP-A-2006-150768, however, has the cover member for blocking the opening, and this increases the size of the device.

SUMMARY

An advantage of some aspects of the invention is that the amount of mist entering an apparatus can be reduced while upsizing of the apparatus is prevented. To solve the above-mentioned problem, a liquid ejecting apparatus according to an aspect of the invention includes a liquid ejection unit including a liquid ejection head for ejecting liquid, a housing accommodating the liquid ejection unit, and a sealing section provided between the liquid ejection unit and the housing. According to this aspect, the sealing section provided between the liquid ejection unit and the housing prevents the movement of mist, and thereby the amount of mist entering the apparatus can be reduced while the upsizing of the apparatus can be prevented compared with the structure discussed in JP-A-2006-150768 in which the covering member is provided.

In this aspect of the invention, the sealing section includes a first protrusion protruding from the liquid ejection head and being in contact with the housing. According to this aspect, the first protrusion protruding from the liquid ejection head can reduce the entering of mist. Furthermore, in this aspect, the first protrusion engages with a recessed portion on a surface of the housing. According to this aspect, the first protrusion engages with the recessed portion on the surface of the housing, and thereby the amount of mist entering the apparatus can be significantly reduced.

In this aspect of the invention, the sealing section includes a second protrusion protruding from the housing and being in contact with the liquid ejection head. According to this aspect, the second protrusion protruding from the housing can reduce the amount of mist entering the apparatus. Furthermore, in this aspect, the second protrusion engages with a recessed portion on a surface of the liquid ejection head. According to this aspect, the second protrusion engages with the recessed portion on the surface of the liquid ejection head, and thereby the amount of mist entering the apparatus can be significantly reduced.

In this aspect of the invention, the liquid ejection unit includes a holding member onto which the liquid ejection head is fixed, and the sealing section includes a third protrusion protruding from one of the holding member and the housing and being in contact with the other one. According to this aspect, the third protrusion protruding from one of the holding member and the housing and being in contact with the other one can reduce the amount of mist entering the apparatus.

In this aspect of the invention, the housing has a first opening, the liquid ejection head has an ejection surface having a plurality of nozzles for ejecting the liquid, the ejecting surface is located inside the first opening in plan view, and the sealing section is provided to surround the first opening in plan view. Accordingly, the amount of mist and dust entering the apparatus can be significantly reduced.

In this aspect of the invention, the liquid ejection unit includes a wiring board on which wiring for transmitting drive signals to control the ejection of the liquid is provided, and the wiring board is disposed on the opposite side of the liquid ejection head to the ejection surface for ejecting the liquid. The adhesion of mist and dust to the wiring on the wiring board may cause an electric failure such as a short circuit in the wiring. Accordingly, the aspect of the invention that is effective to reduce the amount of mist and dust entering the apparatus is suitable for a structure that includes a wiring board.

In this aspect of the invention, the housing has a bottom section on which the liquid ejection unit is fixed, and a first side surface section and a second side surface section protruding from the bottom section and facing each other, a second opening is provided in an area of the bottom section on the side of the second side surface section, a gap is formed between the liquid ejection unit and the second side surface section, and the wiring board is located on the side of the first side surface section in plan view. According to this aspect, while mist can move through the second opening provided in the area of the bottom section on the side of the second side surface section and the gap formed between the liquid ejection unit and the second side surface section, the wiring board is located on the side of the first side surface section, and thereby the mist that has passed through the second opening and the gap hardly reach the wiring board.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
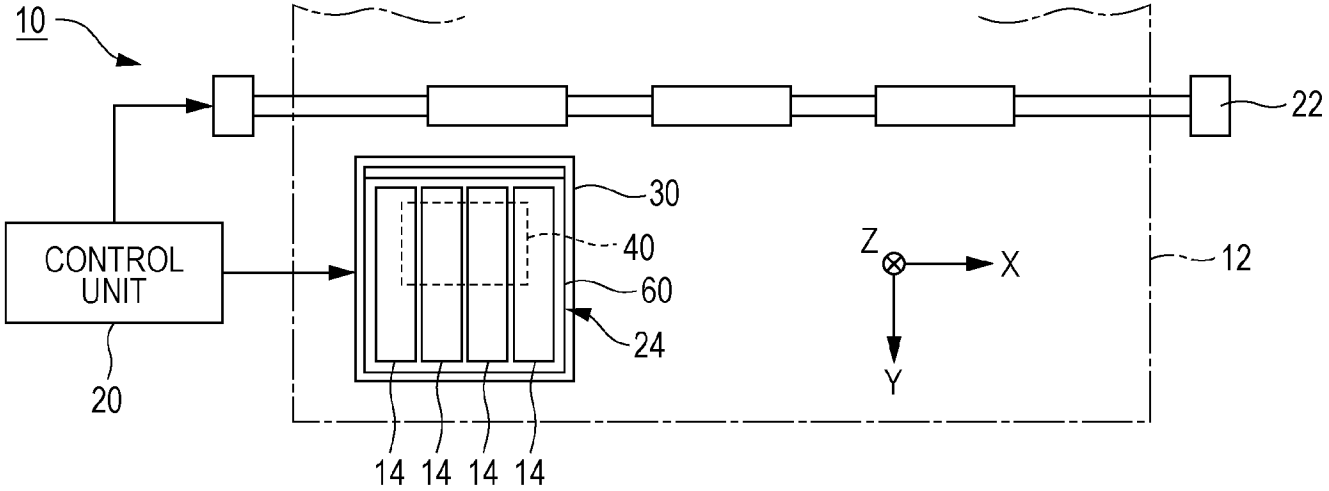
FIG. 1 illustrates a structure of a liquid ejecting apparatus according to a first embodiment.

FIG. 1 illustrates a structure of a liquid ejecting apparatus 10 according to the first embodiment of the present invention. The liquid ejecting apparatus 10 according to the first embodiment is an ink jet printing apparatus that ejects an ink that is an example liquid onto a medium 12 such as printing paper. As illustrated in FIG. 1, the liquid ejecting apparatus 10 includes a control unit 20, a transport mechanism 22, a liquid ejection unit 24, and a carriage 30. The control unit 20 performs overall control of components in the liquid ejecting apparatus 10. The transport mechanism 22 transports the medium 12 in the Y direction under the control of the control unit 20.

The liquid ejection unit 24 is mounted on the carriage 30. A plurality of liquid containers (cartridges) 14 for storing different inks are mounted on the carriage 30 according to the first embodiment. The liquid ejection unit 24 ejects the inks supplied from the liquid containers 14 onto the medium 12 under the control of the control unit 20. The carriage 30 is a housing that supports and transports the liquid ejection unit 24. The control unit 20 reciprocates the carriage 30 in the X directions which intersect (typically, are orthogonal to) the direction the medium 12 is transported. The liquid ejection unit 24 ejects the inks onto the medium 12 simultaneously with the transport of the medium 12 by the transport mechanism 22 and the reciprocating motion of the carriage 30, and thereby an image is formed on the medium 12. In the description below, as illustrated in FIG. 1, the direction perpendicular to the X-Y plane is expressed as the Z direction (typically, the vertical direction). The inks ejected from the liquid ejection unit 24 proceed toward the positive side in the Z direction and reach the surface of the medium 12.

Figure 2:
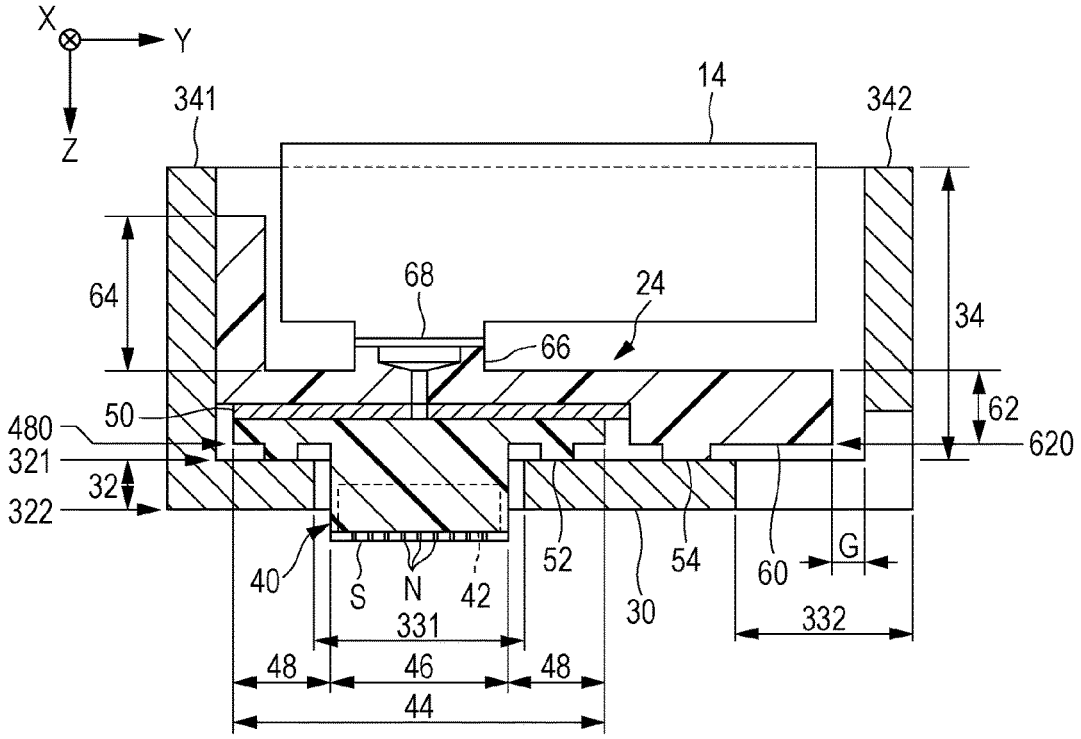
FIG. 2 is a cross-sectional view illustrating a liquid ejection unit and a carriage.
Figure 3:
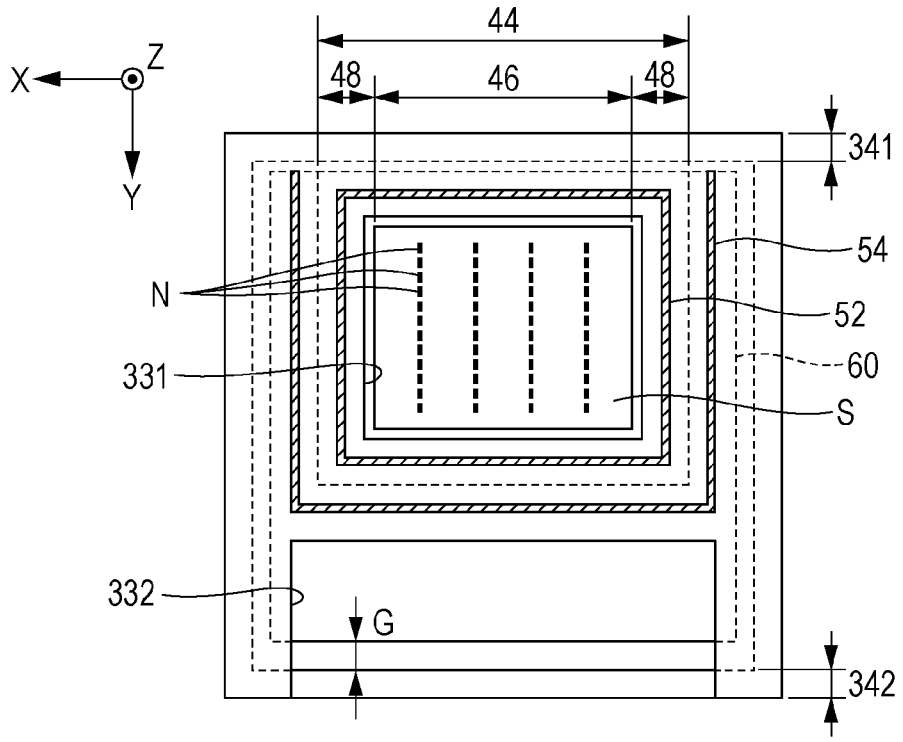
FIG. 3 is a plan view illustrating the liquid ejection unit and the carriage.

FIG. 2 is a cross-sectional view (a cross section perpendicular to the X direction) of the liquid ejection unit 24 and the carriage 30. FIG. 3 is a plan view illustrating the liquid ejection unit 24 and the carriage 30 from the side (the positive side in the Z direction) of the medium 12. As illustrated in FIG. 2, the liquid ejection unit 24 according to the first embodiment includes a liquid ejection head 40, a wiring board 50, and a holding member 60. The liquid ejection head 40 is a recording head that ejects inks from a plurality of nozzles N. As illustrated in FIG. 3, arrays of nozzles N corresponding to respective different inks are provided on a surface (hereinafter, referred to as "ejection surface") S of the liquid ejection head 40, the surface S that faces the medium 12. The wiring board 50 illustrated in FIG. 2 is a substrate that has the wiring for transmitting drive signals to the liquid ejection head 40 to control the ink ejection from each nozzle N. It should be noted that an integrated circuit (not illustrated) for generating drive signals may be provided on the wiring board 50. The holding member 60 is a structure on which the liquid ejection head 40 and the wiring board 50 are fixed. Furthermore, a plurality of liquid containers 14 are detachably supported on the holding member 60 according to the first embodiment.

Figure 4:
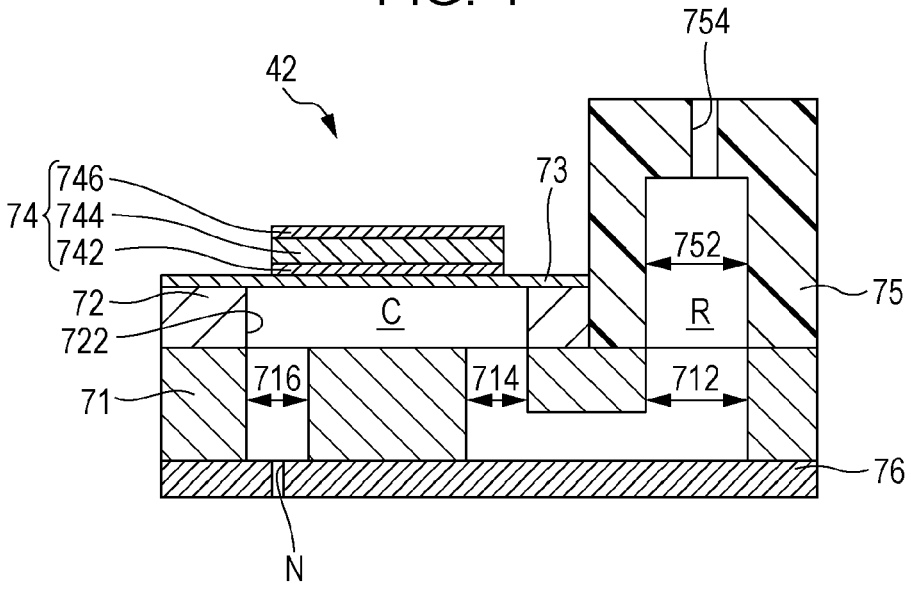
FIG. 4 is a cross-sectional view of a liquid ejection section.

As illustrated in FIG. 2, the liquid ejection head 40 according to the first embodiment includes a liquid ejection section 42 and a supporting member 44. The liquid ejection section 42 is fixed on the supporting member 44, and the supporting member 44 is fixed on the carriage 30. FIG. 4 is a cross-sectional view of the liquid ejection section 42, in which a single nozzle N is focused on. As illustrated in FIG. 4, the liquid ejection section 42 is provided with a pressure chamber substrate 72, a diaphragm 73, a piezoelectric element 74, and a housing section 75 on one side of a channel substrate 71, and a nozzle plate 76 on the other side of the channel substrate 71. The channel substrate 71, the pressure chamber substrate 72, and the nozzle plate 76 may be, for example, silicon plates, and the housing section 75 may be, for example, formed by injection molding using a resin material. The housing section 75 and the supporting member 44 may be formed together. The nozzles N are provided on the nozzle plate 76. The surface of the nozzle plate 76 opposite to the channel substrate 71 serves as the ejection surface S.

The channel substrate 71 has an opening 712, a branch channel (throttle channel) 714, and a communication channel 716. The branch channel 714 and the communication channel 716 are through holes provided in each nozzle N, and the opening 712 is a continuous opening provided through a plurality of nozzles N. A storage portion (recessed portion) 752 provided in the housing section 75 and the opening 712 provided in the channel substrate 71 communicate with each other to define a space that serves as a common liquid chamber (reservoir) R for storing the ink supplied from the liquid container 14 via an introduction channel 754 of the housing section 75.

The pressure chamber substrate 72 has an opening 722 that is provided in each nozzle N. The diaphragm 73 is an elastic deformable plate provided on the surface of the pressure chamber substrate 72 opposite to the channel substrate 71. A space defined by the diaphragm 73 and the channel substrate 71 in each opening 722 of the pressure chamber substrate 72 serves as a pressure chamber (cavity) C into which the ink supplied from the common liquid chamber R via the branch channel 714 is filled. Each pressure chamber C communicates with the nozzle N via a communication channel 716 of the channel substrate 71.

A piezoelectric element 74 is provided on the surface of the diaphragm 73 opposite to the pressure chamber substrate 72 for each nozzle N. The piezoelectric element 74 has a first electrode 742, a piezoelectric material 744, and a second electrode 746, and serves as a drive element. Drive signals are supplied from the wiring board 50 to one of the first electrode 742 and the second electrode 746, and a predetermined reference voltage is supplied to the other one of the first electrode 742 and the second electrode 746. The piezoelectric element 74 deforms in response to the supply of the drive signals and thereby the diaphragm 73 vibrates, and this vibration varies the pressure in the pressure chamber C to cause the ink in the pressure chamber C to be ejected from the nozzle N. It should be noted that the one of the first electrode 742 and the second electrode 746 to which the reference voltage is supplied may be a common electrode for a plurality of piezoelectric elements 74. In the first embodiment, as an example, the piezoelectric liquid ejection section 42 that uses the piezoelectric element 74 to apply mechanical vibration to the pressure chamber C has been described, and alternatively, a thermal liquid ejection section that uses a heating element to apply heat to generate bubbles in a pressure chamber may be employed.

The supporting member 44 in FIG. 2 includes an accommodating section 46 and an extending section 48. As will be understood from FIG. 2 and FIG. 3, the accommodating section 46 is a substantially rectangular parallelepiped section that accommodates the liquid ejection section 42, and the extending section 48 is an edge section horizontally extending from the side surface of the accommodating section 46 around the accommodating section 46. The accommodating section 46 and the extending section 48 may be formed together, for example, by injection molding using a resin material, and alternatively, may be formed by bonding the accommodating section 46 and the extending section 48, which are separately formed, as the supporting member 44. As illustrated in FIG. 2, the wiring board 50 is disposed to face the surface of the supporting member 44 having the accommodating section 46 and the extending section 48, on the side opposite to the ejection surface S when viewed from the supporting member 44.

The holding member 60 in FIG. 2 includes a base section 62 and a side wall section 64. The base section 62 is a substantially plate-like section on which the liquid ejection head 40 and the wiring board 50 are fixed. The side wall section 64 is a wall section that protrudes from the periphery of the base section 62 in the negative side in the Y direction toward the opposite side to the liquid ejection head 40. The base section 62 and the side wall section 64 may be formed together, for example, by injection molding using a resin material, and alternatively, may be formed by bonding the base section 62 and the side wall section 64, which are separately formed, as the holding member 60. It should be noted that the side wall section 64 may be omitted.

A substantially cylindrical supply tube 66 is provided on the surface of the base section 62 opposite to the liquid ejection head 40. Each liquid container 14 is attached to the holding member 60 such that the ink stored in the liquid container 14 is supplied to the supply tube 66. A filter 68 is provided on the top surface of the supply tube 66 to collect foreign materials and bubbles of the ink supplied from the liquid container 14.

As illustrated in FIG. 2, the wiring board 50 and the liquid ejection head 40 are fixed on the side of the base section 62 opposite to the liquid container 14. Specifically, the wiring board 50 is provided between the liquid ejection head 40 and the base section 62 of the holding member 60. The inks supplied from each of the liquid containers 14 to the corresponding supply tube 66 are supplied and filled into the liquid ejection head 40 via the flow channels passing through the base section 62 and the wiring board 50.

The carriage 30 in FIG. 2 has a substantially box shape, and includes a bottom section 32 and a peripheral wall section 34. On the bottom section 32, the liquid ejection unit 24 (the liquid ejection head 40, the wiring board 50, and the holding member 60) is fixed. The bottom section 32 is a substantially rectangular plate-like section, and includes a first surface 321 that is located on the side of the liquid container 14 (upper side) and a second surface 322 that is located on the side of the medium 12 (lower side). As illustrated in FIG. 2 and FIG. 3, the bottom section 32 has a first opening 331 and a second opening 332. The first opening 331 is a substantially rectangular opening (through hole) corresponding to the ejection surface S of the liquid ejection head 40 in plan view (i.e., when viewed from the direction parallel to the Z direction), and the second opening 332 is an opening provided in the positive side in the Y direction when viewed from the first opening 331.

The peripheral wall section 34 is a wall-like section that protrudes from the periphery of the bottom section 32 toward the opposite side of the medium 12, as illustrated in FIG. 2. Specifically, the peripheral wall section 34 is provided all around the bottom section 32 so as to surround a space (i.e., a space in which the liquid ejection unit 24 and the liquid containers 14 are accommodated) on the bottom section 32 on the side opposite to the side facing the medium 12. The peripheral wall section 34 according to the first embodiment includes a section (hereinafter, referred to as "first side surface section") 341 located on the negative side in the Y direction and a section (hereinafter, referred to as "second side surface section") 342 located on the positive side in the Y direction. The first side surface section 341 and the second side surface section 342 face each other with a space therebetween. The first opening 331 is provided in an area in the bottom section 32 on the side of the first side surface section 341, and the second side surface section 342 is provided in an area on the bottom section 32 on the side of the second side surface section 342.

As will be understood from FIG. 3, the outer dimensions of the first opening 331 are larger than those of the accommodating section 46 of the liquid ejection head 40, and the accommodating section 46 is inserted into the first opening 331. Accordingly, the ejection surface S corresponding to the bottom surface of the accommodating section 46 is located inside the first opening 331 in plan view. In other words, the ejection surface S of the liquid ejection unit 24 is exposed from the first opening 331. As will be understood from FIG. 2, the accommodating section 46, which is inserted into the first opening 331 from the side of the first surface 321 of the bottom section 32, protrudes from the side of the second surface 322 toward the side of the medium 12, and the ejection surface S is located on the side closer to the medium 12 than the second surface 322.

The outer dimensions of the first opening 331 are smaller than those of the extending section 48, and the peripheral line of the extending section 48 is located outside the first opening 331 in plan view. Accordingly, as will be understood from FIG. 2 and FIG. 3, the extending section 48 overlaps an area around the first opening 331 of the bottom section 32 of the carriage 30 in plan view. In other words, the surface (hereinafter, referred to as "support surface") 480 of the extending section 48 on the side of the medium 12 faces the area around the first opening 331 of the first surface 321 of the bottom section 32.

Figure 5:
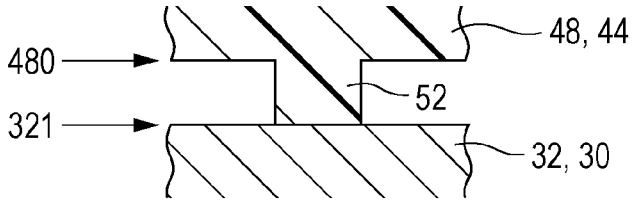
FIG. 5 is an enlarged cross-sectional view of a protrusion of a liquid ejection head.

As illustrated in FIG. 2, the support surface 480 of the extending section 48 has a protrusion 52 (example first protrusion) that protrudes from the support surface 480. Typically, the protrusion 52 can be formed together with the extending section 48, and alternatively, the protrusion 52 that is formed separately from the extending section 48 may be disposed on the support surface 480 of the extending section 48. As illustrated in the enlarged view in FIG. 5, the protrusion 52 according to the first embodiment has a rectangular cross section. As illustrated in FIG. 3, the protrusion 52 is annularly formed (specifically, in a rectangular frame shape) so that the first opening 331 in the area facing the extending section 48 is surrounded by the protrusion 52, the area is around the first opening 331 of the first surface 321 in the bottom section 32. As illustrated in FIG. 2 and FIG. 5, the top surface of the protrusion 52 is in contact with the first surface 321 of the bottom section 32. In other words, the protrusion 52 is provided so as to be in contact with the support surface 480 of the extending section 48 and the first surface 321 of the bottom section 32 so as to separate the space between the extending section 48 and the bottom section 32 into the space inwards from (the side of the first opening 331) the protrusion 52 and the space outwards from the protrusion 52.

As illustrated in FIG. 2, a surface (hereinafter, referred to as "support surface") 620 of the base section 62 of the holding member 60 on the side of the medium 12 faces the first surface 321 of the bottom section 32. The support surface 620 of the base section 62 has a protrusion 54

(example third protrusion) that protrudes from the support surface 620. The protrusion 54 according to the first embodiment has a rectangular cross section similarly to the protrusion 52, and the top surface is in contact with the first surface 321 of the bottom section 32. In other words, the protrusion 54 is provided so as to be in contact with the support surface 620 of the base section 62 and the first surface 321 of the bottom section 32 so as to separate the space between the base section 62 and the bottom section 32 into the space inwards from (the side of the first opening 331) the protrusion 54 and the space outwards from the protrusion 54. As will be understood from FIG. 3, the protrusion 54 according to the first embodiment is provided around the protrusion 52 in plan view. Similarly to the protrusion 52, the protrusion 54 may be formed in loop shaped so as to surround the first opening 331.

The side wall section 64 of the holding member 60 is brought into contact with the inner wall surface (the surface facing the second side surface section 342) of the first side surface section 341 of the carriage 30 to fix the position of the holding member 60 in the Y direction. Specifically, while the side wall section 64 of the holding member 60, on which the liquid ejection head 40 and the wiring board 50 are fixed, for example, using an adhesive, is in contact with the inner wall surface of the first side surface section 341, the liquid ejection head 40, the wiring board 50, and the holding member 60 are fixed on the carriage 30, for example, by a fixing means such as a screw or an adhesive such that the protrusion 52 of the support surface 480 of the liquid ejection head 40 and the protrusion 54 of the support surface 620 of the holding member 60 are brought into contact with the first surface 321 of the carriage 30. While the side wall section 64 of the holding member 60 is in contact with the first side surface section 341 of the carriage 30, a gap (i.e., the gap between the liquid ejection unit 24 and the second side surface section 342) G is formed between the end surface of the holding member 60 opposite to the side wall section 64 and the inner wall surface of the second side surface section 342. Since the first opening 331 in which the liquid ejection head 40 is installed is located on the side of the first side surface section 341, the wiring board 50 that is fixed on the liquid ejection head 40 is located on the bottom section 32 on the side (i.e., the side opposite to the gap G) of the first side surface section 341 in plan view. As described above, the location of the holding member 60 in the Y direction is fixed by the contact with respect to the inner wall surface of the first side surface section 341, and thereby the second opening 332 is formed in the carriage 30 on the side (the positive side in the Y direction) opposite to the first side surface section 341.

The inks ejected from the liquid ejection head 40 may remain suspended as ink mist in the apparatus (specifically, in the space between the medium 12 and the carriage 30) without reaching the surface of the medium 12. Furthermore, dust (for example, paper particles of printing paper or fibers of cloth) produced from the printing paper or a cloth used as the medium 12 may also remain suspended in the apparatus. The mist and dust move in the apparatus due to an air current produced in the apparatus caused by the movement of the medium 12 and the carriage 30. Without the protrusion 52 and the protrusion 54, the mist and dust that have passed through the first opening 331 may pass through the gap between the liquid ejection unit 24 and the carriage 30 and reach the wiring board 50 and the holding member 60. In the first embodiment, the protrusion 52 and the protrusion 54 that are provided between the liquid ejection unit 24 and the carriage 30 prevent the mist and dust from moving, and thereby the amount of mist and dust entering the apparatus can be reduced while the upsizing of the apparatus can be prevented compared with the structure discussed in JP-A-2006-150768 in which the covering member is provided. Furthermore, in the step of fixing the liquid ejection unit 24 to the carriage 30, the protrusion 52 and the protrusion 54 come into contact with the first surface 321 of the carriage 30, and thereby the structure that can reduce the movement of mist and dust can be provided. Accordingly, the amount of mist and dust entering the apparatus can be reduced without complicating the manufacturing process.

In the first embodiment, specifically, the ring-shaped protrusion 52 is provided to surround the first opening 331, and this structure significantly reduces the amount of mist and dust entering the apparatus. Furthermore, in the first embodiment, in addition to the protrusion 52 provided between the liquid ejection head 40 and the carriage 30, the protrusion 54 is also provided between the holding member 60 and the carriage 30. Accordingly, the amount of mist and dust entering the apparatus can be significantly reduced compared with a structure in which only one of the protrusion 52 and the protrusion 54 is provided.

In the first embodiment, the liquid ejection unit 24, which is mounted on the carriage 30, includes the wiring board 50, and airborne mist in the apparatus adheres to the wiring on the wiring board 50, and this structure may cause an electric failure such as a short circuit in the wiring. In view of the above, the structure in which the protrusion 52 and the protrusion 54 can reduce the movement of mist is significantly effective according to the first embodiment in which the liquid ejection unit 24 includes the wiring board 50. In the first embodiment, the gap G formed between the liquid ejection unit 24 and the second side surface section 342 of the carriage 30 communicate with the second opening 332 of the carriage 30, and thereby mist and dust in the apparatus can move through the path passing through the second opening 332 and the gap G. In the first embodiment, however, the wiring board 50 is located on the side of the first side surface section 341 (i.e., on the side opposite to the gap G) of the bottom section 32. Accordingly, mist and dust passing through the second opening 332 and the gap G hardly reach the wiring board 50.

Second Embodiment

Hereinafter, the second embodiment of the present invention is described. In the embodiment described below, the reference numerals used in the description of the first embodiment will be used to components that operate or serve similarly to those in the first embodiment, and detailed descriptions of the components will be omitted.

Figure 6:
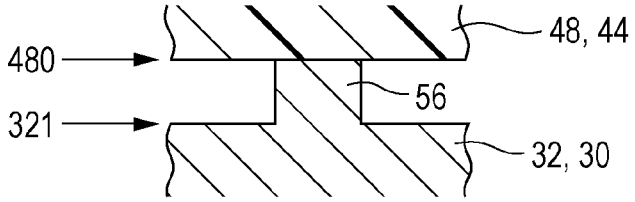
FIG. 6 is an enlarged cross-sectional view of a protrusion according to a second embodiment.

FIG. 6 is an enlarged cross-sectional view of the extending section 48 of the liquid ejection head 40 according to the second embodiment and components around the extending section 48 (part similar to that in FIG. 5). The structure described in the first embodiment has the protrusion 52 provided on the support surface 480 of the liquid ejection head 40 being in contact with the first surface 321 of the bottom section 32 of the carriage 30. In the second embodiment, as illustrated in FIG. 6, a protrusion 56 (example second protrusion) that protrudes from the first surface 321 of the bottom section 32 is provided to the first surface 321. The protrusion 56 has a rectangular cross section and the top surface of the protrusion 56 is in contact with the support surface 480 of the extending section 48. Similarly to the protrusion 52 according to the first embodiment, the protrusion 56 is annularly formed so that the first opening 331 in the area facing the extending section 48 is surrounded by the protrusion 52, the area is around the first opening 331 of the first surface 321 in the bottom section 32.

Figure 7:
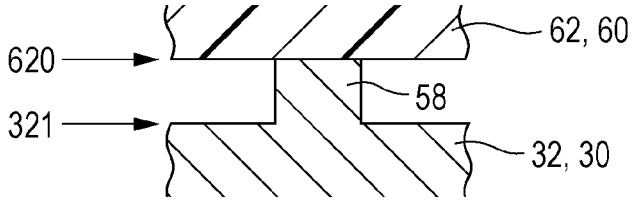
FIG. 7 is an enlarged cross-sectional view of a protrusion according to a modification of the second embodiment.

In the second embodiment, effects similar to those in the first embodiment can also be provided. In the second embodiment, the protrusion 56 provided between the liquid ejection head 40 and the bottom section 32 has been described, and alternatively, as illustrated in FIG. 7, a protrusion 58 that protrudes from the first surface 321 of the bottom section 32 and is in contact with the support surface 480 of the holding member 60 may be provided on the first surface 321 in place of the protrusion 54 (or together with the protrusion 54) according to the first embodiment.

Third Embodiment

Figure 8:
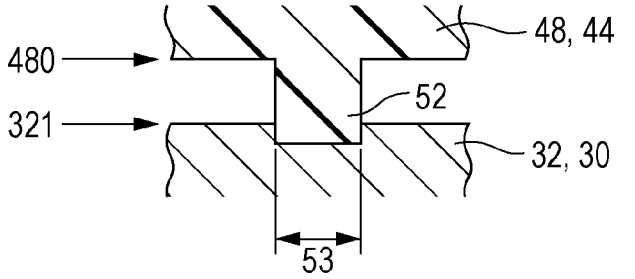
FIG. 8 is an enlarged cross-sectional view of a protrusion according to a third embodiment.

FIG. 8 is an enlarged cross-sectional view of the extending section 48 of the liquid ejection head 40 according to the third embodiment, and components around the extending section 48. As illustrated in FIG. 8, in the third embodiment, a recessed portion (groove portion) 53 that corresponds to the flat shape of the protrusion 52 is provided on the first surface 321 of the bottom section 32 of the carriage 30, in addition to the protrusion 52 similar to that in the first embodiment provided on the support surface 480 of the liquid ejection head 40. As will be understood from FIG. 8, the protrusion 52 engages with the recessed portion 53. In other words, the top surface of the protrusion 52 is in contact with the bottom surface of the recessed portion 53.

In the third embodiment, effects similar to those in the first embodiment can also be provided. In the third embodiment, the protrusion 52 engages with the recessed portion 53, and thereby the movement of mist and dust in the apparatus can be more effectively reduced compared with the first embodiment in which the protrusion 52 is in contact with the first surface 321 of the bottom section 32.

Figure 9:
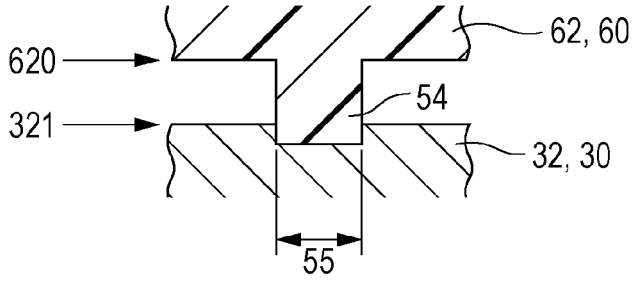
FIG. 9 is a cross-sectional view of a protrusion according to a modification of the third embodiment.

In FIG. 8, the protrusion 52 has been described, and similarly, as illustrated in FIG. 9, the protrusion 54 of the holding member 60 may be engaged with a recessed portion 55 provided on the first surface 321 of the bottom section 32. Furthermore, the protrusion 56 or the protrusion 58 may be engaged with a recessed portion (not illustrated) provided on the support surface 480 of the liquid ejection head 40 in the structure according to the second embodiment having the protrusion 56 or the protrusion 58 on the first surface 321 of the bottom section 32.

Modifications

The above-described embodiments may be modified in various ways. Specific examples of the modifications will be described below. It should be noted that two or more modifications selected from those below may be combined without a contradiction between them.

Figure 10:
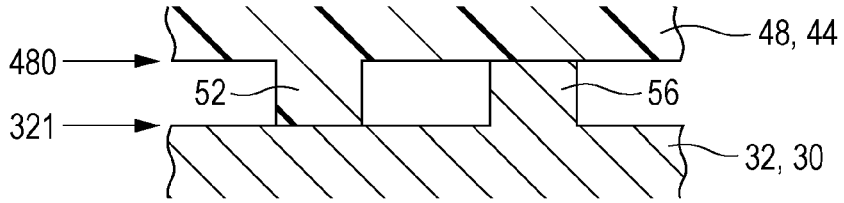
FIG. 10 is a cross-sectional view of a protrusion according to a modification.

1. As illustrated in FIG. 10, the protrusion 52 according to the first embodiment that protrudes from the support surface 480 of the liquid ejection head 40 and is in contact with the first surface 321 of the bottom section 32, and the protrusion 56 according to the second embodiment that protrudes from the first surface 321 and is in contact with the support surface 480 may be provided at different locations in plan view. Similarly, the protrusion 54 according to the first embodiment that protrudes from the support surface 620 of the holding member 60 and is in contact with the first surface 321 of the bottom section 32, and the protrusion 58 in FIG. 7 that protrudes from the first surface 321 and is in contact with the support surface 620 may be provided at different locations. The above-described protrusions 52, 54, 56, and 58 may be comprehensively expressed as a sealing section that is disposed between the liquid ejection unit 24 and the carriage 30 (example housing) to reduce entering of mist and dust.

Figure 11:
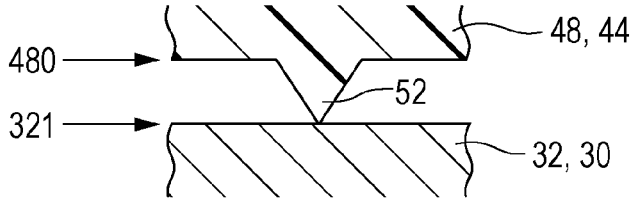
FIG. 11 is a cross-sectional view of a protrusion according to a modification.
Figure 12:
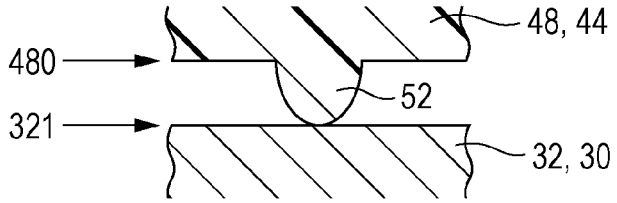
FIG. 12 is a cross-sectional view of a protrusion according to a modification.

2. In the above-described embodiments, the protrusion 52 has a rectangular cross section, however, the shape of the protrusion 52 is not limited to the above-described example. For example, as illustrated in FIG. 11, the protrusion 52 that has a triangular cross section, or as illustrated in FIG. 12, the protrusion 52 that has a curved surface (for example, an arc-shaped surface) may be provided. In FIG. 11 and FIG. 12, the protrusion 52 of the extending section 48 has been described, however, similarly to the above, the protrusion 54 provided on the holding member 60 and the protrusion 56 and the protrusion 58 provided on the bottom section 32 of the carriage 30 may be any shape. Furthermore, regardless of the shapes of the protrusions 52, 54, 56, and 58, the structure according to the third embodiment in which the protrusions are engaged with recessed portions on the opposite surface may be employed.

3. In the above-described embodiments, the serial liquid ejecting apparatus 10 in which the liquid ejection unit 24 is mounted on the carriage 30 and reciprocated is described, and alternatively, a line liquid ejecting apparatus in which a plurality of nozzles are provided in the whole area in the width direction of the medium 12 may be applied to the invention. The carriage 30 described in the above embodiments and the structure that supports the liquid ejection unit in the line liquid ejecting apparatus may be comprehensively expressed as a housing for accommodating a liquid ejection unit.

4. In the above-described embodiments, a plurality of liquid containers 14 are mounted on the carriage 30, and alternatively, similarly to the above-described embodiments, the present invention may be applied to a structure in which the liquid containers 14 are mounted to the body section (section other than the carriage 30) of the liquid ejecting apparatus 10.

5. The liquid ejecting apparatus 10 in the above-described embodiments may be employed in devices dedicated for printing, and various devices such as facsimile apparatuses and copying machines. It should be noted that the usage of the liquid ejecting apparatus according to the present invention is not limited to printing. For example, a liquid ejecting apparatus that ejects solutions of coloring materials can be used as a manufacturing apparatus for forming color filers for liquid crystal display apparatuses. Furthermore, a liquid ejecting apparatus that ejects solutions of conductive materials can be used as a manufacturing apparatus for producing wiring and electrodes on wiring boards.

The entire disclosure of Japanese Patent Application No.:2015-216389, filed Nov. 4, 2015 is expressly incorporated by reference herein.

What is claimed is:

1. A liquid ejecting apparatus comprising:

a liquid ejection unit including a liquid ejection head for ejecting liquid;

a housing accommodating the liquid ejection unit; and a sealing section provided between the liquid ejection unit and the housing, wherein the sealing section includes a protrusion protruding from one of the holding member and the housing and being in contact with the other one.

2. The liquid ejecting apparatus according to claim 1, wherein the protrusion protrudes from the liquid ejection head and being in contact with the housing.

3. The liquid ejecting apparatus according to claim 2, wherein the protrusion engages with a recessed portion on a surface of the housing.

4. The liquid ejecting apparatus according to claim 1, wherein the protrusion protrudes from the housing and being in contact with the liquid ejection head.

5. The liquid ejecting apparatus according to claim 4, wherein the protrusion engages with a recessed portion on a surface of the liquid ejection head.

6. The liquid ejecting apparatus according to claim 1, wherein the liquid ejection unit includes a holding member onto which the liquid ejection head is fixed.

7. The liquid ejecting apparatus according to claim 1, wherein the housing has a first opening, the liquid ejection head has an ejection surface having a plurality of nozzles for ejecting the liquid, the ejecting surface is located inside the first opening in plan view, and the sealing section is provided to surround the first opening in plan view.

8. The liquid ejecting apparatus according to claim 1, wherein the liquid ejection unit includes a wiring board on which wiring for transmitting drive signals to control the ejection of the liquid is provided, and the wiring board is disposed on the opposite side of the liquid ejection head to the ejection surface for ejecting the liquid.

9. The liquid ejecting apparatus according to claim 8, wherein the housing has a bottom section on which the liquid ejection unit is fixed, and a first side surface section and a second side surface section protruding from the bottom section and facing each other, a second opening is provided in an area of the bottom section on the side of the second side surface section, a gap is formed between the liquid ejection unit and the second side surface section, and the wiring board is located on the side of the first side surface section in plan view.

* * * * *